United States Patent [19]

Murata

[11] 4,073,299

[45] Feb. 14, 1978

[54] THREE-DIMENSIONAL EMBROIDERED ARTICLE AND THE METHOD FOR THE PRODUCTION OF THE SAME

[76] Inventor: Shuhei Murata, 29-4, Higashimachi, Tojiin, Kita, Kyoto, Japan

[21] Appl. No.: 800,201

[22] Filed: May 25, 1977

[30] Foreign Application Priority Data

Nov. 11, 1976 Japan ..... 51-136598

[51] Int. Cl.[2] ..... A41C 3/00

[52] U.S. Cl. ..... 128/425; 128/516; 2/243 B; 112/439

[58] Field of Search ..... 112/439, 440, 441; 2/243 R, 243 B; 128/516, 425; D2/24

[56] References Cited

U.S. PATENT DOCUMENTS

| | | | |
|---|---|---|---|
| D. 168,980 | 3/1953 | Whitman | D2/24 |
| 1,599,069 | 9/1926 | Trueb | 2/243 B X |
| 2,490,701 | 12/1949 | Nagel | 2/243 B X |
| 3,101,717 | 8/1963 | Korman | 128/516 X |
| 3,187,753 | 6/1965 | Hershon | D2/24 X |

FOREIGN PATENT DOCUMENTS

| | | | |
|---|---|---|---|
| 166,763 | 4/1934 | Switzerland | 128/425 |

*Primary Examiner*—Alfred R. Guest
*Attorney, Agent, or Firm*—Darby & Darby

[57] ABSTRACT

The three-dimensional embroidered article is produced by preparing a plurality of elemental cloth pieces each having a embroidery pattern including pattern lines of embroidery extending substantially along its edge lines and sewing said plurality of elemental cloth pieces together along their embroidered edge lines.

3 Claims, 6 Drawing Figures

THREE-DIMENSIONAL EMBROIDERED ARTICLE AND THE METHOD FOR THE PRODUCTION OF THE SAME

BACKGROUND OF THE INVENTION

This invention relates to new and improved three-dimensional embroidered articles and the method for the production of the same.

Conventionally, in producing a three-dimensional cloth article, such as a cup of a brassiere having a curved configuration or a three-dimensional embroidered article having an embroidery pattern provided thereon over the entire area, since it is difficult or impossible to embroider such three-dimensional article in its three-dimensional condition, it is usual practice first to embroider raw material cloth on a lace embroidering machine, cut the embroidered cloth into a number of small cloth pieces of specified size, and, finally, sew such small cloth pieces together to provide a desired three-dimensional configuration. In such conventional method, however, when the embroidered cloth is to be cut into small cloth pieces, it is cut to a specified size while neglecting the pattern of the embroidery without seeing to it that the cutting plane line agrees with the pattern of the embroidery. As a result, the pattern of the embroidery is irregularly cut, so that the resulting three-dimensional article has the pattern of the embroidery misaligned along the boundary line between the small cloth pieces where they are sewn together, making it impossible to construct a coordinated embroidery pattern, and, moreover, the embroidery overlaps itself along said boundary line when the small cloth pieces are sewn together, producing a thick portion, or, reversely, portions of the cloth which have no embroidery are sewn together, producing a thin portion, so that the thickness becomes non-uniform, causing the boundary line to appear more clearly. Thus, the drawback is that only a rough product can be obtained whose commercial value is low to the extent that the fact that it is formed by sewing cloth pieces together can be known at a glance.

The principal object of the present invention is to provide a method which eliminates the drawback described above and which enables a three-dimensional article to be produced relatively easily whose embroidery pattern is coordinated as a whole and has a high aesthetic value, giving an impression that the article is formed of a single piece of cloth.

SUMMARY OF THE INVENTION

According to the invention, a plurality of elemental cloth pieces each having an embroidery pattern including embroidered pattern lines extending substantially along its edge lines. Those elemental cloth pieces thus prepared are then sewn together along their embroidered edge lines to form a continuous three-dimensional cloth article having an embroidered patterns.

More specifically the method for the production of a three-dimensional embroidered article according to the invention comprises the steps of joining a plurality of paper pattern pieces together to form a three-dimensional paper pattern resembling an article to be obtained, drawing a design pattern for embroidery on the surface of said three-dimensional paper pattern including pattern lines extending substantially along seam lines which are produced as a result of said joining operation, cutting said three-dimensional paper pattern along said pattern lines again into a plurality of paper pattern pieces, preparing a plurality of cloth pieces having pattern embroidery laid thereon according to the pattern drawn on the plurality of paper pattern pieces, and sewing said plurality of cloth pieces together along the embroidery lines corresponding to said pattern lines.

The preferred embodiments of the invention are illustrated in the accompanying drawings.

BRIEF DESCRIPTION OF THE DRAWINGS

The drawing illustrates a method of producing a brassiere cup according to the present invention.

DETAILED DESCRIPTION OF THE INVENTION

Figure 1:
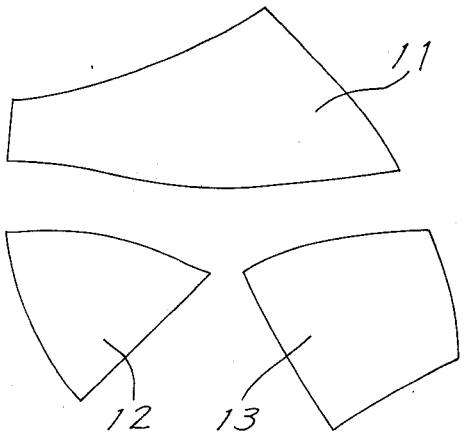
FIG. 1 is a plan view of paper pattern pieces.

Referring to FIG. 1, three planar paper pattern pieces 11, 12 and 13 are prepared as if a cup of a brassiere to be obtained were developed and cut into three parts.

Figure 2:
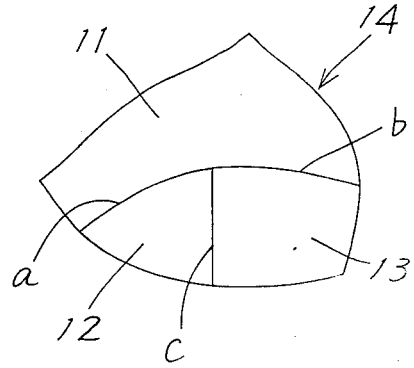
FIG. 2 is a plan view of a three-dimensional paper pattern.

The three paper pattern pieces 11, 12 and 13 are then joined together to provide a three-dimensional paper pattern 14 having a curved surface similar to the brassiere cup to be obtained, as shown in FIG. 2. The joining operation can be facilitated by employing pasting while using separate paper pieces for joining or by employing an adhesive tape. Therefore, the three-dimensional paper pattern 14 has seam lines *a*, *b*, and *c* resembling ridgelines formed thereon,.

Figure 3:
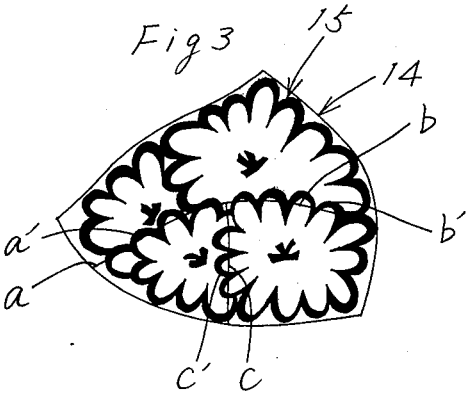
FIG. 3 is a plan view of the three-dimensional paper pattern having a design pattern drawn thereon.

Then, as shown in FIG. 3, any desired design pattern 15 is drawn on the outer surface of the three-dimensional paper pattern 14 with a writing utensil. In this connection, the design pattern 15 should be a balanced pattern as a whole including pattern lines *a'*, *b'* and *c'* drawn substantially along the seam lines *a*, *b*, and *c*.

Figure 4:
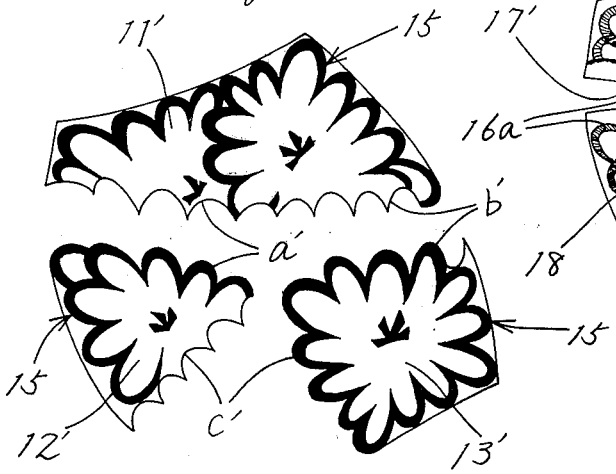
FIG. 4 is a plan view of paper pattern pieces obtained by dividing the three-dimensional paper pattern.

The three-dimensional paper pattern 14 is cut along the pattern lines *a'*, *b'* and *c'* drawn substantially along said seam lines, again into three paper pattern pieces 11', 12' and 13' as shown in FIG. 4.

Figure 5:
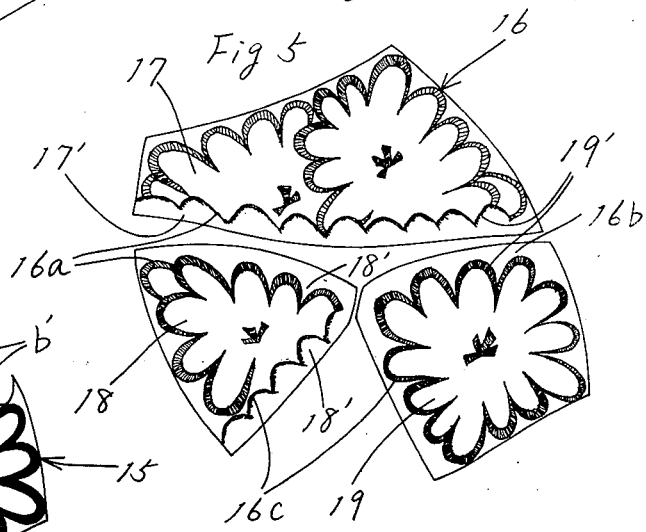
FIG. 5 is a plan view of embroidered cloth pieces according to the paper pattern.

Then, three cloth pieces 17, 18 and 19 shown in FIG. 5 are prepared which have pattern embroidery 6 laid thereon according to the pattern drawn on said paper pattern pieces 11', 12' and 13'. More particularly, the cloth pieces 17, 18 and 19 are of substantially the same size and shape as the paper pattern pieces 11', 12' and 13' and has the embroidery 16 laid thereon on a lace embroidering machine according to the pattern 15 drawn on said paper pattern pieces.

Figure 6:
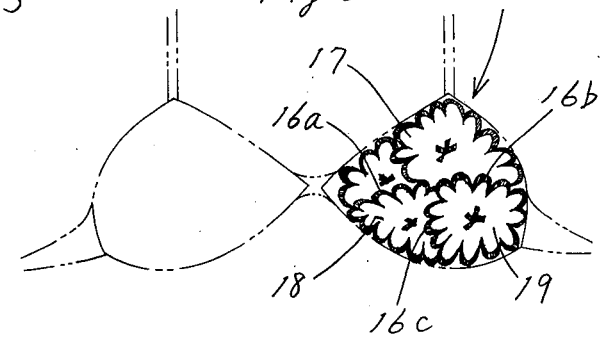
FIG. 6 is a plan view of a completed article.

The three cloth pieces 17, 18 and 19 are then sewn together along the embroidery lines 16*a*, 16*b* and 16*c* corresponding to the pattern lines *a'*, *b'* and *c'* which are the cutting plane lines for said paper pattern. More particularly, in an operation as if the paper pattern were brought from the condition of FIG. 4 back to that of FIG. 3, the three cloth pieces 17, 18 and 19 are abutted against each other and then sewn together along the abutting lines, i.e., the embroidery lines 16*a*, 16*b* and 16*c*, said sewing being in the form of overcasting along the stitch direction of the embroidery lines 16*a*, 16*b* and 16c using a sewing thread similar to an embroidery thread. Thus, as shown in FIG. 6, a desired embroidered article 20, i.e., a brassiere cup, is completed.

In addition, in the three cloth pieces 17, 18 and 19 in the condition shown in FIG. 5, if the embroidery lines 16a, 16b and 16c are provided with extra edges 17', 18' and 19' outwardly extending therefrom, this is convenient for sewing since such extra edges may be removed by being cut on the back side after sewing.

The three-dimensional embroidered article 20 obtained in the manner described above has the seam lines of the three cloth pieces aligned with the embroidery lines 16a, 16b and 16c, and since the pattern embroidery 16 is not cut, the sewing condition is not discernible, especially on the front side. The pattern embroidery 16 is coordinated as a whole and beautiful, having an appearance as if it were single embroidery having a three-dimensional configuration. Moreover, the seam lines are not of non-uniform thickness, so that the feel of the article when used is good.

In addition, in the above-described method, the article 20 may be made a seen-through lace embroidered article as by making it a chemical lace by forming the cloth pieces 17, 18 and 19 of a material which is solble in chemicals.

As is apparent from the above description, according to the invention, as a result of the fact that a pattern for embroidery is drawn on a three-dimensional paper pattern with the pattern lines extending substantially along the seam lines of said paper pattern and that said pattern lines provide a basis for the cutting plane lines of the paper pattern and for the embroidery lines and sewing lines of the article, there is obtained a three-dimensional embroidered article having a beautiful curved surface as if it were a single-piece three-dimensional article having an embroidery pattern which is coordinated as a whole.

Further, the method of the present invention is applicable not only to the production of brassiere cups but also to the production of other three-dimensional articles including caps, gloves, clothing, footwear, umbrellas, pouches, furniture, sundries for home use, clothing accessories and various covers.

What I claim is:

1. A method for the production of a three-dimensional embroidered article comprising the steps of preparing a plurality of elemental cloth pieces each having an embroidery pattern including pattern lines of embroidery extending substantially along its edge lines, and sewing said plurality of elemental cloth pieces together along their embroidered edge lines to form a continuous three-dimensional cloth article having an embroidered pattern.

2. A method for the production of a three-dimensional embroidered article comprising the steps of joining a plurality of paper pattern pieces together to form a three-dimensional paper pattern resembling an article to be obtained, drawing a design pattern for embroidery on the surface of said three-dimensional paper pattern including pattern lines extending substantially along seam lines which are produced as a result of said joining operation, cutting said three-dimensional paper pattern along said pattern lines again into a plurality of paper pattern pieces, preparing a plurality of cloth pieces having pattern embroidery laid thereon according to the pattern drawn on the plurality of paper pattern pieces, and sewing said plurality of cloth pieces together along the embroidery lines corresponding to said pattern lines.

3. A three-dimensional embroidered article comprising a plurality of cloth pieces joined together by seaming to form in a three-dimensional shape, each of said cloth pieces having an elemental embroidery pattern including at least embroidery pattern lines extending substantially along lines of said seaming.

* * * * *